United States Patent [19]

Dahlstrom

[11] 4,040,712

[45] Aug. 9, 1977

[54] DOUBLE-ACTING ELECTRICAL RECEPTACLE

[75] Inventor: Arvid Dahlstrom, Chicago, Ill.

[73] Assignee: Dahltron Corporation, Lombard, Ill.

[21] Appl. No.: 652,390

[22] Filed: Jan. 26, 1976

[51] Int. Cl.[2] ..... H01R 13/16

[52] U.S. Cl. ..... 339/255 R

[58] Field of Search ..... 339/14, 163, 164, 166, 339/254, 255, 256, 259, 262

[56] References Cited

U.S. PATENT DOCUMENTS

| | | | |
|---|---|---|---|
| 2,706,803 | 4/1955 | Templeton | 339/259 R |
| 2,770,786 | 11/1956 | Czyzewski | 339/164 R |
| 3,029,405 | 4/1962 | Buchanan | 339/164 R |
| 3,304,392 | 2/1967 | Isler | 339/254 R |

FOREIGN PATENT DOCUMENTS

| | | | |
|---|---|---|---|
| 80,893 | 7/1934 | Sweden | 339/255 R |

*Primary Examiner*—Joseph H. McGlynn
*Attorney, Agent, or Firm*—Edward D. Gilhooly

[57] ABSTRACT

A double-acting electrical receptacle includes a body member, contact members positioned in the body member, and a resilient member. The contact members consist of a first member and a second member positioned oppositely the first member. The first and second contact members are connected operatively for engagement with the sides of a prong of a plug. The resilient member is arranged between the first and second members for urging resiliently the contact members against the sides of the prong.

10 Claims, 3 Drawing Figures

DOUBLE-ACTING ELECTRICAL RECEPTACLE

BACKGROUND OF THE INVENTION

This invention relates generally to electrical receptacles and more particularly, it relates to an improved construction of electrical receptacles for connecting with prong of a conventional plug wherein contact members provide a more efficient and effective constant contact force between the plug and the receptacle.

Heretofore, the contact members in prior art devices were essentially a metal contact plate which would be subject to change in its resiliency due to the insertion and removal of an electrical plug during its continued use and thus, could not provide a constant contact pressure on the prongs. It would, therefore, be desirable to provide an electrical receptacle having contact members that apply a constant contact force between the plug and the receptacle.

Further, due to this change in resiliency the plug would initially be difficult to insert and remove from the receptacle and then after continued use, the plug would not be gripped with sufficient pressure to effectively maintain the plug in engagement. Therefore, it would be desirable to provide an electrical receptacle that will permit the ease of insertion and removal of the prongs of a plug throughout the life of the receptacle.

Another problem encountered in the prior art devices is that if a person touches the prong side of the plug with his finger or fingers while attempting to insert the plug into the receptacle, the person will receive a shock from the electrical current. Consequently, it would be advantageous to set the contacting members of the electrical receptacle farther back from the top of the main body so as to prevent energizing the prongs until the plug is inserted all the way into the receptacle and thus avoiding a shock to the user.

SUMMARY OF THE INVENTION

Accordingly, it is an object of the present invention to provide a new and improved electrical receptacle which has all of the aforementioned features and advantages.

Another object of the present invention is to provide a double-acting electrical receptacle having contact members that give a more efficient and effective constant contact force between the plug and the receptacle.

Another object of the present invention is to provide a double-acting electrical receptacle that will permit the ease of insertion and removal of the prongs of the plug throughout the life of the receptacle.

Still another object of the present invention is to provide a double-acting electrical receptacle wherein the contact members are set farther back from the top section of the main body member of the receptacle so as to prevent energizing the prongs until the plug is inserted all the way into the receptacle and thus avoiding a shock to the user.

In accordance with these aims and objectives, the present invention is concerned with the provision of a double-acting electrical receptacle which includes body means, contact means positioned in the body means, and resilient means. The contact means consist of a first contact member and a second contact member positioned oppositely the first contact member. The first and second contact members are connected operatively for engagement with the sides of a prong of a plug. The resilient means is arranged between the first and second contact members for urging resiliently the contact means against the sides of the prongs.

Additionally, the contact means are set farther back from a top section of the body means of the receptacle thereby gripping a substantially small end portion of the prongs in order to prevent electrical energy from being applied to the prongs until the plug is inserted all the way into the receptacle and thus avoiding a shock to the user.

Furthermore, the present invention includes clamps means consisting of a wire clamp and a screw. The wire clamp has a central portion and arcuate end portions, the arcuate end portions of the wire clamp and one of the first and second contact members retaining open ends of a stripped wire therebetween via the screw.

The present invention is particularly efficient and effective in providing a double-acting electrical receptacle wherein the contact members give a constant contact force between the plug and the receptacle. Additionally, the instant electrical receptacle is relatively simple in construction and is inexpensive to manufacture and easy to assemble for use.

BRIEF DESCRIPTION OF THE DRAWINGS

These and other objects and advantages of the present invention will become more fully apparent from the following detailed description when read in conjunction with the accompanying drawings, wherein.

DETAILED DESCRIPTION OF THE PREFERRED EMBODIMENT

Figure 1:
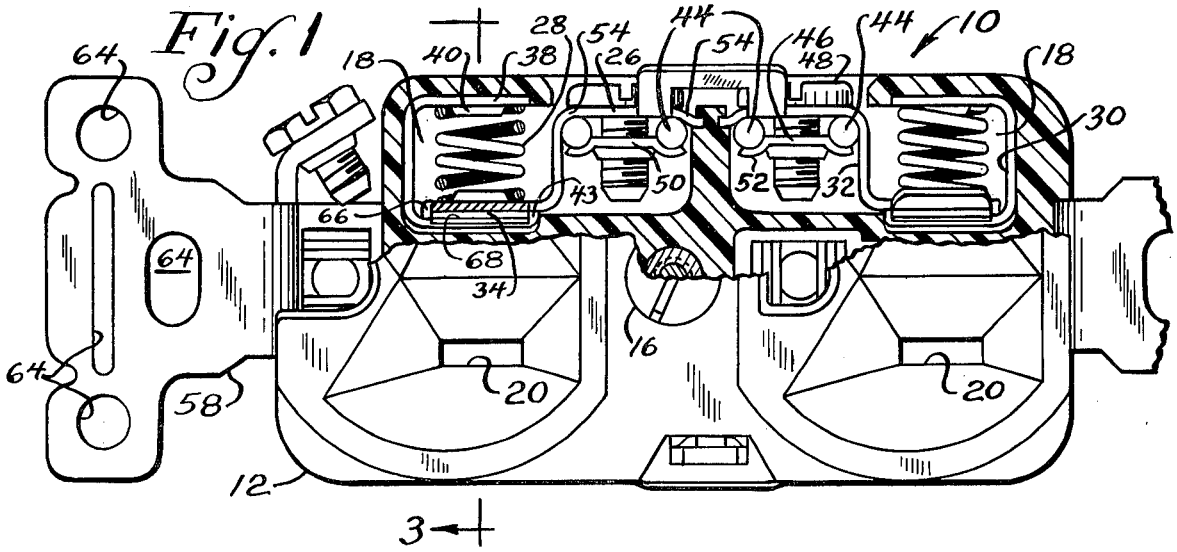
FIG. 1 shows a top plan, partly sectionalized, view of a double-acting electrical receptacle, according to the present invention.
Figure 2:
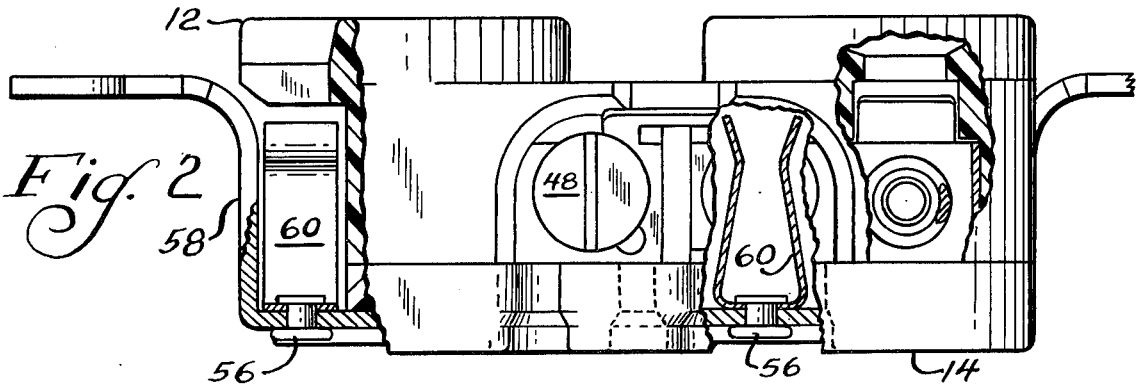
FIG. 2 shows a side elevational, partly sectionalized, view of the double-acting electrical receptacle, according to the present invention.

Referring now in detail to the drawings of the particular illustration, there is shown a duplex electrical receptacle of the present invention formed of an electrical insulating material and is designated generally by reference numeral 10. The receptacle 10 has a main body 12 and a detachable back cover 14 which is connected fixedly to the main body 12 by a screw 16. The screw 16 is inserted into an opening in the main body 12 and the threaded ends of the screw 16 is then tightened into an internally threaded opening (now shown) in the back cover 14. The receptacle 10 is provided with a plurality of recesses or openings 18 for accommodating contact members (which will be described more thoroughly hereinafter). The main body 12 is provided in its top section with a plurality of slots 20 for receiving prongs 22 of a conventional plug 24 and for communicating cooperatively with the recesses 18.

Each of the recesses 12 houses contact members for receiving the prongs 22 of the plug 24, the contact members comprising a bus bar 26, a coil spring 28, and a shunt element 30. The bus bar 26 is formed as a conductive strip of metallic material, such as brass, having relatively good resiliency. The bus bar consists of a substantially U-shaped portion 32 and extended end portions 34. Each of the end portions 34 has an annularly raised section 36 for insertion into the inner part of the coil spring 28. While this bus bar 26 is made as one integral element, it can be severed or cut in the middle section of the U-shaped portion 32 to provide two independent electrical receptacles.

The shunt element 30 is made in the form of a U-shaped construction, one of the sides 38 of the shunt 30 having an annularly raised section 40 on its inner side for insertion into the inner part of the other end of the coil spring 28. The other side 42 of the shunt 30 has an outwardly extending or curved flange 43 which operatively contacts the bus bar 26. The coil spring 28 has one end thereof bearing against the annularly raised section 36 of the bus bar 26 and the other end thereof bearing against the annularly raised section 40 of the shunt 30, as best shown in FIG. 1.

In order to supply electrical energy to the receptacle, conductor lead wires 44 having their ends stripped can be attached readily to the bus bar 26 via clamp means consisting of a wire clamp 46 and screw 48. The wire clamp 46 is provided with a central portion 50 having a not-shown opening and arcuate end sections 52. The open ends of the ends of the lead wires 44 are efficiently held or retained in position between the rounded portions 54 of the bus bar 26 and the arcuate end sections 52 of the wire clamp 46 once the screw 48 is inserted through an opening (not shown) in the bus bar 26 and then tightened into the not-shown threaded opening in the central portion 50 of the wire clamp 46, as can be seen in FIG. 1. It should be noted that all four lead wires 44 have been shown for convenience of illustration. However, any number of lead wires can be utilized depending upon the desired purpose. This clamp means provide for an effective, rapid and easy insertion and removal of the lead wires 44 thereby reducing labor costs.

Rivets 56 are mounted in mounting brackets 58 for attaching fixedly in position ground clips 60. Ground clips 60 are adapted to receive a third prong 62 (shown in phantom) of the plug 24 for grounding the electrical receptacle 10. The mounting brackets 58 are provided with a plurality of openings 64 to facilitate the connection of the receptacle 10 to an outlet box in a wall opening or the like.

In the unused position (there being no plug inserted), the contact members consisting of the bus bar 26, coil spring 28, and shunt element 30 are positioned in the recesses 18 such that coil spring 28 is disposed in the recess 18 having one end thereof urging against the shunt element 30 and the other end thereof urging against the end portion 34 of the bus bar 26. The end portion 34 has an inwardly extending or curved flange 66 which is in surface contact with the side 42 of the shunt 30, and the flange 43 of the shunt 30 is in surface contact with the end portion 34 of the bus bar 26. However, there can be some space or "play" in the shunt 30 and the recess 18 to accommodate the insertion of plug 24 during use so that the outside surface of the side 38 of the shunt 30 may not be in surface contact with the side of the main body 12. The flange 66, end portion 34, flange 43, and side 42 of the shunt 30 form and define a prong receiving space 68 which is disposed substantially in alignment with the slot 20, as best seen in FIG. 1.

Figure 3:
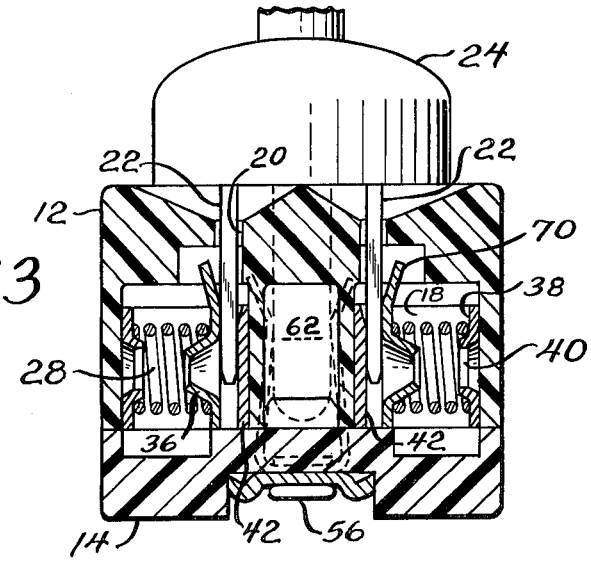
FIG. 3 shows a sectional view taken along the lines 3—3 of FIG. 1, showing a conventional electrical plug inserted into the double-acting electrical receptacle.

Referring to FIG. 3 of the drawings, the plug 24 having parallel prongs 22 which are spaced apart a proper distance are inserted in use into the main body of the electrical receptacle through the slots 20. After the prongs 22 enter the slot 20, the prongs 22 proceed into the prong receiving spaces 68 which are adapted to be yieldably displaced by the prongs thereby causing compression of the coil spring 28 and bending a top section 70 of the end portion 34 of the bus bar 26 at an incline away from the prongs 22. In reaction to this, the end of the coil spring 28 bearing against the annularly raised portion 36 exerts a pressure to frictionally engage the end portion 34 with one side of the prongs 22 and the other end of the coil spring 28 bearing against the annularly raised portion 40 of the shunt 30 exerts a pressure to frictionally engage the outside surface of the side 38 of the shunt 30 with the side of the main body 12, which in turn, creates a force to cause the inside surface of the side 42 of the shunt 30 to frictionally engage the other side of the prongs 22. Accordingly, the side 42 of the shunt 30 and the inside surface of the end portion 34 of the bus bar 26 define contacting members giving a double-acting capability which grip and secure firmly the prongs therebetween thereby insuring adequate and constant contact pressures each and every time the prong is inserted into the electrical receptacle 10.

In view of these new and novel contact members, it has been discovered that a substantially small portion of the prongs was required to be gripped and yet still gives sufficient contacting pressures. Consequently, the contacting members can be set farther back from the top of the main body 12 of the electrical receptacle 10 so that if a person touches with his fingeror fingers the prong side of the plug 22 and attempts thereafter to insert the plug into the receptacle, the thickness of the fingers will prevent the person from bringing the prongs 22 into engagement with contacting members and thus avoiding the receiving of a shock from the electrical current.

From the foregoing description of the double-acting electrical receptacle embodying the present invention, it can be seen there is provided an electrical receptacle wherein the contract members provide a more efficient and effective constant contact force between the plug and the receptacle. Further, the contacting members can be set farther back from the top of the main body of the electrical receptacle so as to prevent energizing of the prongs until the plug is inserted all the way into the receptacle and thus avoiding a shock to the user. Additionally, the electrical receptacle of the present invention is relatively simple in construction and easy to manufacture and assemble for use.

While there has been illustrated and described what is at present to be a preferred embodiment of the present invention, it will be understood by those skilled in the art that various changes and modifications may be made, and equivalents may be substituted for elements thereof without departing from the true scope of the invention. In addition, many modifications may be made to adapt to a particular situation or material to the teachings of the invention without departing from the central scope thereof. Therefore, it is intended that this invention not be limited to the particular embodiment disclosed as a best mode contemplated for carrying out this invention, but the invention will include all embodiments following within the scope of the appended claims.

What is claimed is:

1. A double-acting electrical receptacle comprising:

main body means having a plurality of recesses, the body means including a top section having slots for receiving prongs of a plug, the slots communicating cooperatively with the recesses;

contact means disposed in the recesses, the contact means including a bus bar, a shunt element, and a coil spring;

said bus bar consisting of a substantially U-shaped portion and extended end portions, each of the end portions having an inwardly extending flange;

the shunt element being formed of a U-shaped construction and having a first side and second side positioned oppositely and spaced apart from the first side, the first side of the shunt element having an outwardly extending flange;

said coil spring being normally disposed in the recesses so that one end thereof is urged against the second side of the shunt element and the other end thereof is urged against the extended end portion of the bus bar to resiliently bias said second side and said end portion in opposite directions toward each other;

said first side of the shunt element with the outwardly extending flange and the end portion of the bus bar with the inwardly extending flange being positioned operatively in surface contact to define therebetween a plug receiving space which is aligned with the slot in the top section of the body means and being adapted to yieldably move apart for displacement by the prongs of the plugs; and the prongs being thereafter frictionally gripped between the first side of the shunt element and the end portion of the bus bar thereby insuring adequate and constant contact pressure.

2. A double-acting electrical receptacle as claimed in claim 1, wherein the contact means are set farther back from the top section of the body means of the receptacle thereby gripping a substantially small portion of the prongs in order to prevent electrical energy fron being applied to the prongs until the plug is inserted all the way into the receptacle and thus avoiding a shock to the user.

3. A double-acting electrical receptacle as claimed in claim 1, wherein the second side of the shunt element has an annularly raised portion for bearing against the end of the coil spring, and wherein the extended end portion of the bus bar has an annularly raised portion for bearing against the other end of the coil spring.

4. A double-acting electrical receptacle as claimed in claim 3, wherein upon the insertion of the prongs of the plug into the prong receiving spaces, the coil spring is compressed and, in reaction, the end of the coil spring bearing against the annularly raised portion of the bus bar exerts a pressure to frictionally engage the end portion thereof with one side of the prongs and the other end of the coil spring bearing against the annularly raised portion of the shunt element exerts a pressure to frictionally engage the second side of the shunt element with the body means, which, in turn, creates a force to cause the first side of the shunt element to frictionally engage the other side of the prongs.

5. A double-acting electrical receptacle as claimed in claim 4, wherein the first side of the shunt element and the end portion of the bus bar define contacting members for frictionally engaging the opposite sides of the prongs through compression of the coil spring to grip and secure firmly the prongs therebetween thereby insuring constant contact pressures.

6. A double-acting electrical receptacle as claimed in claim 1, further including clamp means comprising a wire clamp and screws, the wire clamp having a central portion and arcuate end portions, said bus bar having bent portions forming rounded areas on the bus bar, said rounded areas and said arcuate end portions of the wire clamp retaining exposed ends of a stripped wire therebetween via the screws.

7. A double-acting electrical receptacle as claimed in claim 6, wherein the second side of the shunt element has an annularly raised portion for bearing against the end of a coiled spring, and wherein the extended end portion of the bus bar has an annularly raised portion for bearing against the other end of the coil spring.

8. A double-acting electrical receptacle as claimed in claim 7, wherein upon insertion of the prongs of the plug into the prong receiving spaces, the coil spring is compressed, and, in reaction, the end of the coil spring bearing against the annularly raised portion of the bus bar exerts a pressure to frictionally engage the end portion thereof with one side of the prongs and the other end of the coil spring bearing against the annularly raised portion of the shunt element exerts a pressure to frictionally engage the second side of the shunt element with the body means which, in turn, creates a force to cause the first side of the shunt element to frictionally engage the other side of the prongs.

9. A double-acting electrical receptacle as claimed in claim 8, wherein the first side of the shunt element and the end portion of the bus bar define contacting members for frictionally engaging the opposite sides of the prongs through compression of the coil spring to grip and secure firmly the prongs therebetween thereby insuring constant contact pressures.

10. A double-acting electrical receptacle comprising:

body means;

contact means disposed in the body means and being connected operatively for engagement with the sides of a prong of a plug, said contact means including a bus bar, a shunt element, and resilient means;

said bus bar including extended end portions;

said shunt element being formed of a U-shaped construction and having a first side and a second side positioned oppositely and spaced apart from the first side; and said resilient means being normally disposed in the body means between the second side of the shunt element and one of the extended end portions of the bus bar to bias them in opposite directions toward each other to resiliently urge the first side of the shunt element and one of the extended end portions against the sides of the prong inserted therebetween.

* * * * *